US010132091B2

(12) United States Patent
Wilkes, Jr.

(10) Patent No.: US 10,132,091 B2
(45) Date of Patent: Nov. 20, 2018

(54) COMPLIANT TRIM FOR CONCRETE SLABS

(71) Applicant: Robert David Wilkes, Jr., League City, TX (US)

(72) Inventor: Robert David Wilkes, Jr., League City, TX (US)

( * ) Notice: Subject to any disclaimer, the term of this patent is extended or adjusted under 35 U.S.C. 154(b) by 0 days.

(21) Appl. No.: 15/095,136

(22) Filed: Apr. 10, 2016

(65) Prior Publication Data

US 2016/0319536 A1 Nov. 3, 2016

Related U.S. Application Data

(60) Provisional application No. 62/179,056, filed on Apr. 27, 2015.

(51) Int. Cl.

| | |
|---|---|
| ***E04B 1/68*** | (2006.01) |
| ***E04G 17/00*** | (2006.01) |
| ***E02D 29/16*** | (2006.01) |

(52) U.S. Cl.

CPC ..... *E04G 17/004* (2013.01); *E02D 29/16* (2013.01)

(58) Field of Classification Search

CPC ..... E02D 29/16; E04G 17/005; E04G 17/004; E04B 1/6807

USPC ..... 52/396.05, 169.11, 254, 293.3, 393; 404/47, 48

See application file for complete search history.

(56) References Cited

U.S. PATENT DOCUMENTS

| | | | | | |
|---|---|---|---|---|---|
| 1,730,067 | A * | 10/1929 | Fischer | E01C 23/021 | 404/47 |
| 2,045,089 | A * | 6/1936 | Kyte | E01C 11/126 | 404/47 |
| 3,595,142 | A * | 7/1971 | Via | E01D 19/06 | 404/49 |
| 3,782,846 | A * | 1/1974 | Johnson | E01C 23/021 | 404/48 |
| 4,050,206 | A * | 9/1977 | Utsuyama | E01C 11/126 | 404/48 |
| 4,198,176 | A * | 4/1980 | Bentz | E01C 11/126 | 249/9 |
| 4,335,548 | A * | 6/1982 | Rehbein | E02D 31/00 | 52/169.11 |
| 4,346,542 | A * | 8/1982 | Tateno | E01C 11/10 | 404/48 |
| 5,375,386 | A * | 12/1994 | Goad | E01C 11/106 | 404/69 |
| 5,888,017 | A * | 3/1999 | Corrie | E04F 15/02005 | 404/64 |

(Continued)

*Primary Examiner* — Basil S Katcheves

(57) ABSTRACT

A compliant trim for use between concrete slabs is disclosed, intended to seal the joints and provide a decorative cover over the forms. The compliant trim is placed on the forms prior to the pouring of concrete. The compliant trim contains features which anchor the compliant trim to the slab at numerous points along its length, thereby constraining the compliant trim against any shrinkage effects, and doing so in a manner that introduces minimal stress concentration into the slabs. When the compliant trim is anchored to both of the adjacent slabs, it is capable of following slab motions due to thermal expansion or other environmental effects. The surface of the compliant trim may be used to support the screed. Additionally, the compliant trim may be used to produce a chamfered or radius edge, thereby eliminating the need to radius-trowel the slab.

8 Claims, 11 Drawing Sheets

(56) References Cited

U.S. PATENT DOCUMENTS

| | | | | |
|---|---|---|---|---|
| 5,970,671 | A * | 10/1999 | Bifano | E04B 1/765 428/603 |
| 6,039,503 | A * | 3/2000 | Cathey | E01C 11/10 14/73.1 |
| 6,354,053 | B1 | 3/2002 | Kerrels | |
| 6,491,468 | B1 | 12/2002 | Hagen | |
| 6,751,919 | B2 | 6/2004 | Calixto | |
| 7,547,158 | B1 * | 6/2009 | Mucci | E01C 11/08 404/47 |
| 7,806,624 | B2 | 10/2010 | McLean et al. | |
| 8,091,306 | B2 | 1/2012 | Kerrels | |
| 8,132,380 | B2 * | 3/2012 | Wilkes, Jr. | E04B 1/6812 52/393 |
| D664,669 | S * | 7/2012 | Schoonover | D25/121 |
| 9,062,453 | B1 * | 6/2015 | Maziarz | E04B 1/68 |

* cited by examiner

COMPLIANT TRIM FOR CONCRETE SLABS

CROSS-REFERENCE TO RELATED APPLICATION

U.S. provisional application 62/179,056

STATEMENT REGARDING FEDERALLY FUNDED RESEARCH OR DEVELOPMENT

Not Applicable

BACKGROUND OF THE INVENTION

The field of the invention is in the preparation of concrete forms, specifically, in the preparation of the separator (expansion joint) inserted prior to the pouring of two adjacent concrete sections. The present invention is placed upon the expansion joint prior to the pour, and remains anchored to the concrete to cover the expansion joint once the concrete has cured.

Concrete used for pedestrian or vehicular traffic must be separated into slabs to accommodate many factors such as shrinkage during cure, environmental changes, aging, and uneven settling over years of service. Large areas are divided into slabs through the use of wood, fiber-board, or similar 'forms', which are used primarily for their convenience and low cost, rather than for aesthetic or maintenance considerations. These forms are left between slabs after curing, and are sometimes referred to as 'expansion joints'.

Prior art consists of two techniques to finish and seal concrete expansion joints. These two methods can be divided into cure-in-place liquid sealants, and covers applied over the forms, and left in-place.

Use of liquid sealants, while the most common method, has several drawbacks. A space for them must be created by the removal of a portion of the form after some period of concrete cure. This secondary operation must be performed with the consideration of many environmental factors which may be detrimental to the performance of the sealant: precipitation, or the likelihood thereof, a proper temperature for the curing of the material, the presence of wind-blown debris during the pour and cure, and the control of traffic or other disturbance during the cure of the sealant.

The second, newer method consists of form covers applied before the pour, which cover the top of the forms, such that after the pour, only the cover is visible. The first example, shown in FIG. 11, has a pair of arrow-shaped features to preclude the removal of the cover from the form after the pour. This example, however, fails to allow for the eventual rot and disappearance of the form. With the disappearance of the form, this cover can collapse inward, and will then be free to be removed or driven into the gap. Additionally, any motion of the slabs tending to increase the space between the slabs will cause separation between the slab and the form cover. This allows the intrusion of water, seed and debris, which will allow weeds and grasses to occupy this space. The present invention addresses this by providing anchoring features that will keep the compliant trim attached to the concrete, whether or not the forms are present. Additionally, the present invention will tolerate movement of the slabs, while still maintaining a seal with the concrete.

One additional example is shown in FIG. 12. This cover provides ample features for the anchoring of the cover to the concrete slab. It fails to account for the weakening of the slab that such features will create, nor does it properly consider the slump angle of the concrete. Wet concrete is a thick fluid, with a natural angle of repose, or 'slump' angle. During the pour, it will be difficult to force the concrete into the spaces below the anchoring features, necessitating a vibratory action to try to get the concrete to settle and hopefully fill the undercut areas. As these areas are invisible, it is almost impossible to verify that all these spaces are filled, and that the slab is void-free. The present invention acknowledges this angle, and does not contain features which would be difficult to engage during the pour. It should be noted, however, that even if a void-free pour were attained, the compressive strength of the form cover, being many orders of magnitude less than concrete, will not support the concrete above it. As a result, as in the case of a void, a cantelever of concrete that is significantly weaker than the rest of the slab is produced at the expansion joints. In practice these areas have been observed to crack and fail prematurely.

While both of these cited examples have their strengths and weaknesses, they both share an additional critical weakness, in that they do not address axial shrinkage of the cover. Flexible plastic materials contain plastisizing agents which continue to evolve from the material over their lifetime. This results in shrinkage of the material, which is typically only noticed over long lengths. The examples cited above do not provide any features to prevent shrinkage along their length. The present invention provides features to anchor itself to the slabs it separates all along its length as well as providing anchoring features to preclude pull-out. Additionally, the features which preclude pull-out also act as water and weed intrusion barriers.

In summary, prior art fails to address several key issues in the mechanical attachment of the cover to the concrete, resulting in a weakened slab or dependence on the presence of the forms for structural integrity. Prior art additionally fails to recognize effects that may only be manifested several years after installation, such as shrinkage of the compliant cover or gapping due to slab motion.

BRIEF SUMMARY OF THE INVENTION

The subject compliant trim fits over commonly used forms or 'expansion joint' materials, used in the production of a concrete slab.

One important aim of the proposed invention is the method used to anchor it to the slabs between which it has been cast. The features used to anchor the invention are designed to minimize stress concentrations on the slab, reducing the tendency of the slab to crack at the expansion joints. This cracking phenomena is known to practitioners of the art, and has been seen in application of prior art expansion joint covering products. It is an object of the invention to greatly reduce the propensity for cracking over existing methods.

It is a further aim of the invention to provide attachment and constraint to the concrete not only perpendicular to, but also in the direction of its length; the invention is therefore attached to both slabs in a manner to allow some relative slab movement, but the invention possesses features that are not a continuous extruded profile. These non-continuous features prohibit relative motion between the compliant cover and the slab at numerous points along its length. Such an anchoring method distributed along the length of the invention forces each side of the compliant trim to match the position of the slab it is anchored to, precluding differential thermal expansion between the slab and the invention. Most importantly, it also defeats the effects of shrinkage of polymeric materials, which is commonly seen in expansion joint products. Reduction in length, or shrinkage over a period of years has been observed in both thermoset and thermoplastic rubber-like materials, and is likely a result of continued evolution of plastisizing agents.

It is a third aim of the invention to foresee the eventual rot and disintegration of the form, and to provide a form cover which will retain structural integrity and joint sealing capability with or without the presence of the form.

It is also envisioned that the invention may also be used when only one slab is being cast, as is the case when a driveway is poured up to an existing foundation or wall. In such cases, the slab-anchoring features are simply omitted on the side that is not being poured. Attachment to one slab is sufficient to prevent shrinkage and the other benefits that the invention provides.

To provide both strength for the concrete and improved anchoring for the invention to the concrete, a new and novel anchoring method is provided. As it is economical and practical to produce form covers as an extrusion, the invention begins as an extrusion, and through an additional manufacturing operation, features are created which produce the superior properties disclosed herein.

BRIEF DESCRIPTION OF THE SEVERAL VIEWS OF THE DRAWINGS

FIG. 2 shows the cross-section of a pair of concrete slabs 3, and a form 2. This represents a slab that has been screed then troweled to produce a rounded edge 8*b* on slab 3. The rounded, or 'radiused' edge 8*b* is used to reduce the propensity of edge breakage. This method is widely used for sidewalks, driveways, patios, and the like.

FIG. 1 represents a traditional concrete installation; FIG. 4 is the improved installation, employing the present invention.

FIG. 18 shows an isometric view of one embodiment, with anchoring means 5 consisting of extension 15, interrupted by notches 13. Notches 13 may be rectangular, as shown, or may be any other shape as may be convenient for manufacture, such as semi-circular, saw-tooth, or the like.

DETAILED DESCRIPTION OF THE INVENTION

The invention as disclosed herein is a cover for concrete forms, preferably made from a compliant polymer. Use of polymeric materials allow for a rigid or a flexible product, and may be produced in any number of colors. These polymeric materials may be thermoform or thermoset materials, recycled or virgin materials, and in the preferred embodiment they are somewhat flexible to allow their use on curved forms, and they may also be coiled for storage or transport prior to use.

Form materials used in concrete preparation are typically wood or fiber-board. Lumber use for forms varies considerably; rot-resistant species are preferred, although not always used. Fiber-board is made from asphalt-impregnated fibrous materials. It is considered obvious that other materials may be used for such forms, and the dimensions of the invention may be tailored to fit any variation in the form size. It is a further advantage that the current invention allows for less desirable, discolored, or damaged materials to be used, as they will be invisible after the pour has been completed.

The invention may be produced as an interference fit over the forms, so as to be self-anchoring to the form during the pour. Should additional positional control be desired, it may be nailed, stapled, or otherwise attached to said forms. If nails, staples, or similar attachment methods are used, it is preferable to apply the fasteners through the sides of the compliant trim, so they will not be visible after the cure. Use of adhesives, either temporary or permanent, is also envisioned.

Figure 1:
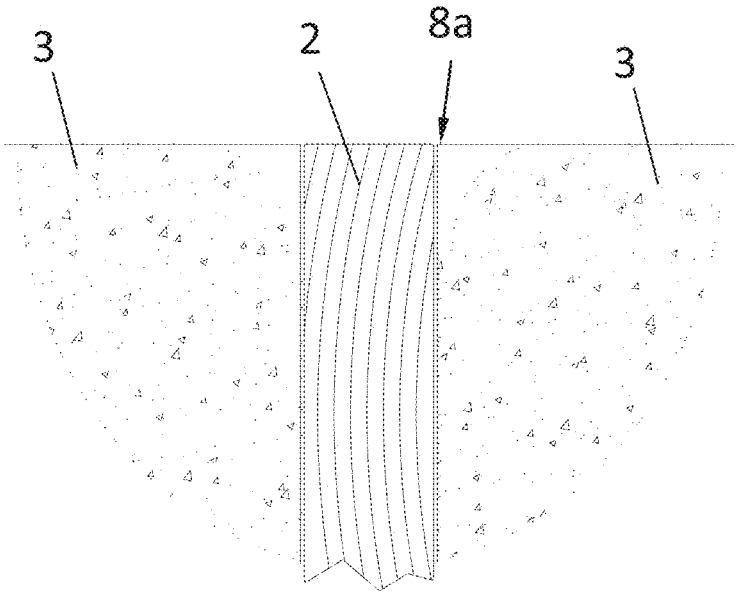
FIG. 1 shows the cross-section of a pair of concrete slabs 3, and a form 2. This represents an in-process slab that has been screed, or a finished slab with no edge treatment 8*a*, such as is commonly found in exposed aggregate driveways.
Figure 2:
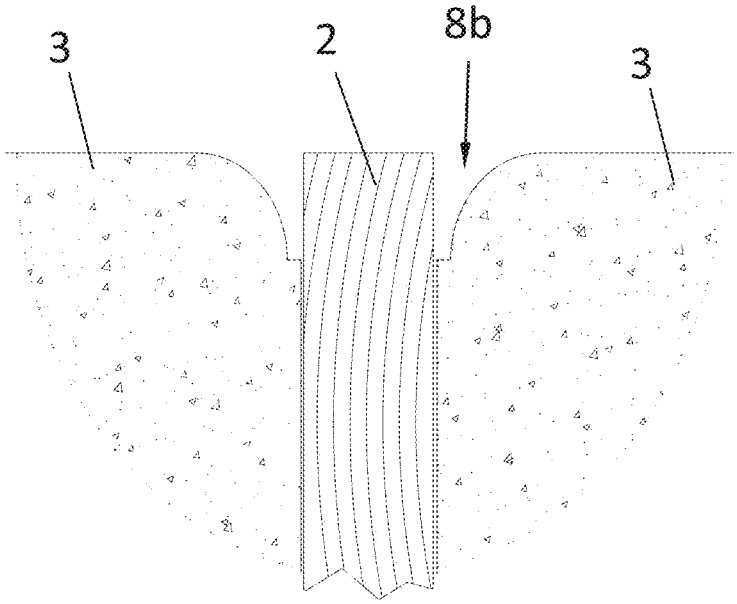
Figure 3:
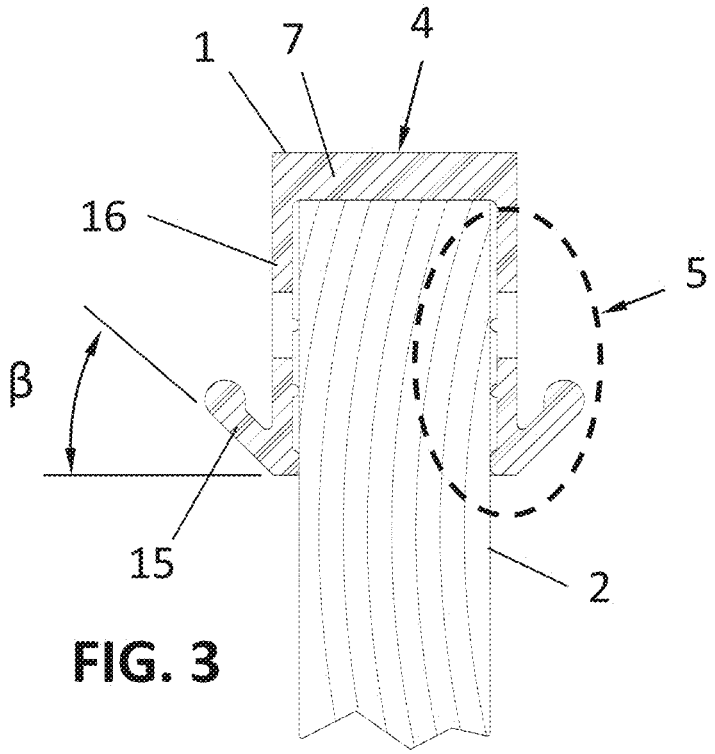
FIG. 3 is a cross-section view of a compliant trim 1, installed upon a form 2. The surface 4 of the cover 7 will be the only part of the compliant trim 1 visible after concrete has been poured. Anchoring means 5, on either side of form 2, extend downward from cover 7. Anchoring means 5 consists of a downward projection 16, and an upward-facing extension 15, at an angle β. It should be noted that the extension 15 need not be straight; it may have a concave, convex, wavy, jagged or irregular shape, but will in general follow an upward trajectory, preferably, at an angle β that is equal to, or greater than the angle of repose of the concrete, so as to eliminate unfilled areas beneath the compliant trim 1 that could become voids in the finished slab 3. Extension 15 may additionally possess one or more protrusions 9 and recesses 8, which will become geometrically locked with the concrete. It is recognized that an increased size of the tip of protrusion 9, will increase the strength of this geometric lock, which is beneficial. It is also beneficial that protrusion 9 be of a round shape, so as to maximize the radius produced in the cast concrete, whereby the stress concentration in the concrete is minimized. Extension 15 may also function without protrusion 9, as is illustrated by FIG. 20, however, use of a round protrusion 9 is preferred.
Figure 4:
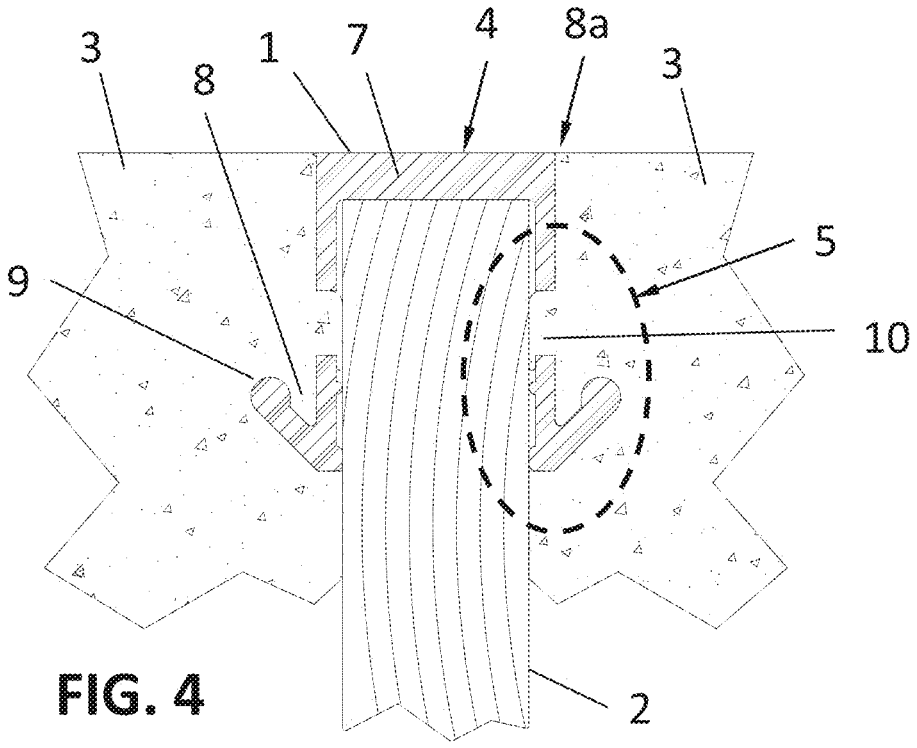
FIG. 4 shows the cross-section of a pair of concrete slabs 3, and a form 2. Note that this is the same compliant trim 1 as seen in FIG. 3. Compliant trim 1 rests atop form 2, and the anchoring means 5 of compliant trim 1 is surrounded by a concrete slab 3. The edge treatment 8*a* of the slab 3 is a 90 degree angle, typically used for exposed aggregate driveways or parking lots.
Figure 5:
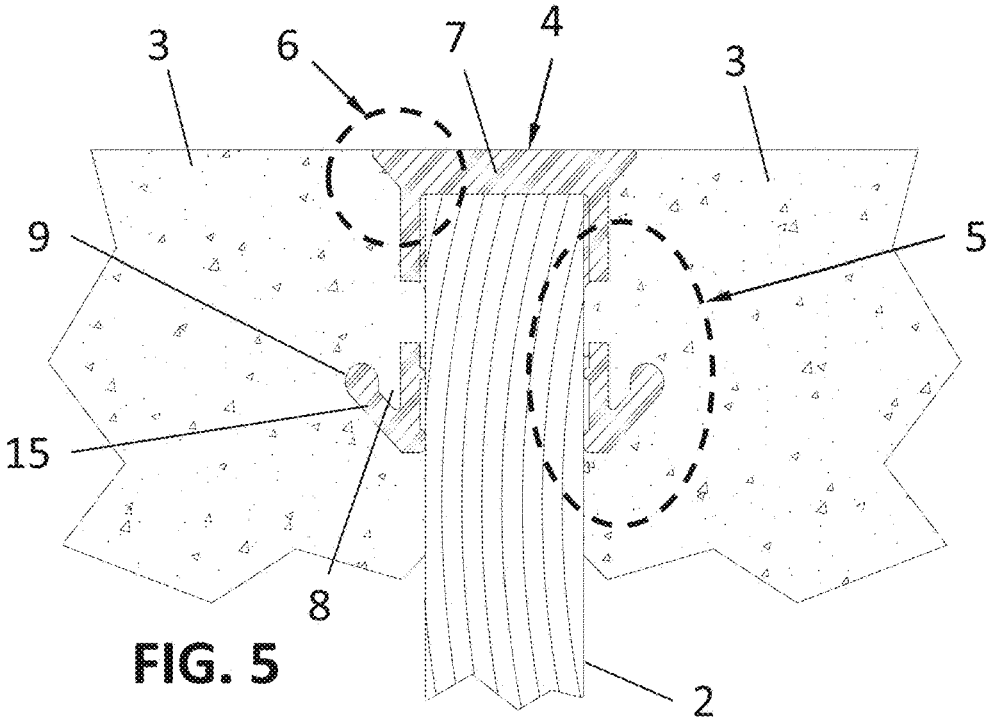
FIG. 5 shows a cross-section of the preferred embodiment of the invention, as also shown in isometric view in FIG. 19. Compliant trim 1 consists of a cover 7 with surface 4, and a pair of anchoring means 5 extending along either side of form 2. At both intersections of the cover 7 and the anchoring means 5, there is an edge treatment means 6, which will produce an edge chamfer on the slab 3. Anchoring means 5 contains an extension 15 at an angle β, with protrusion 9 at its extremity. This feature provides torturous path for water intrusion between the slab 3 and the compliant cover 1, and attachment of the compliant trim 1 to the slab 3 in the event that the slabs move relative to each other. Anchoring means 5 additionally possesses a series of holes 10 along its length. Internal ribs 12 on the anchoring means 5 create small spaces between the anchoring means 12 and the form 2, such that some concrete will flow though the holes 10 and mechanically lock the compliant trim 1 to the slab 3. The holes 10 provide resistance to motion along the length of the compliant trim 1, which can be caused by temperature, shrinkage, or other environmental factors.
Figure 6:
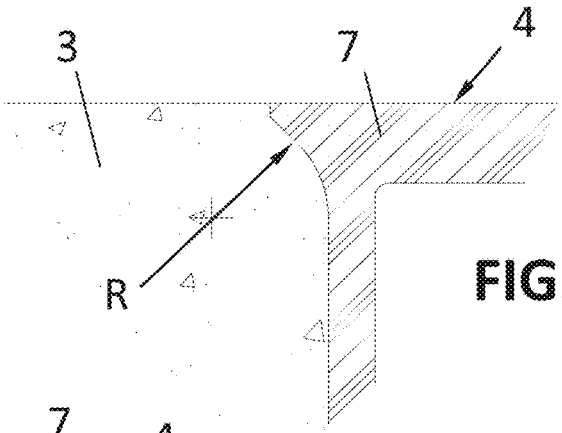
FIG. 6 shows a cross-section of the invention, a detailed view of the edge treatment 6 seen in FIG. 5. Surface 4 will remain visible after the concrete pour. Edge treatment 6 shown here is a radius designated by 'R'.
Figure 7:
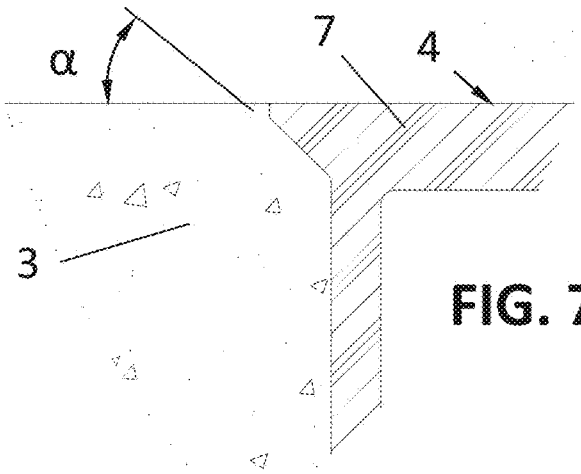
FIG. 7 shows a cross-section of the invention, a detailed view of the edge treatment 6 seen in FIG. 5. Surface 4 will remain visible after the concrete pour. Edge treatment 6 shown here is a chamfered edge. The chamfer angle 'α' shown in the figure will reduce the tendency for the edge breakage due to applied loads.
Figure 8:
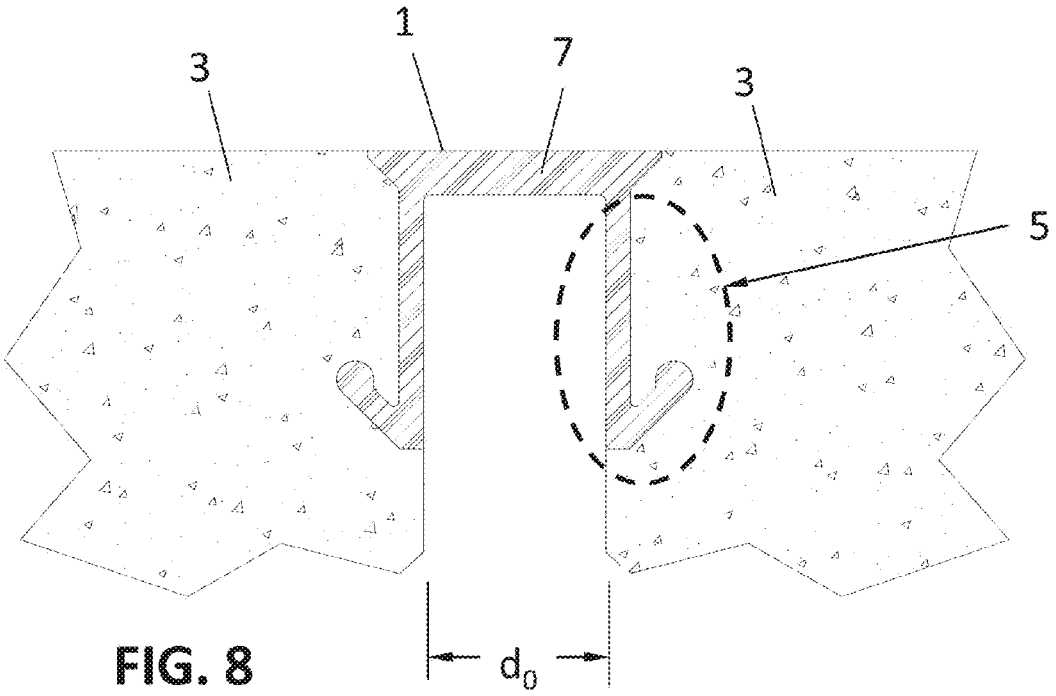
FIG. 8 shows a compliant trim 1, after the wooden form has rotted away, leaving a gap $d_0$, with anchoring means 5 surrounded by concrete 3. Gap $d_0$ is initially equal to the width of the form, as shown in FIG. 5, but may over time increase or decrease.
Figure 9:
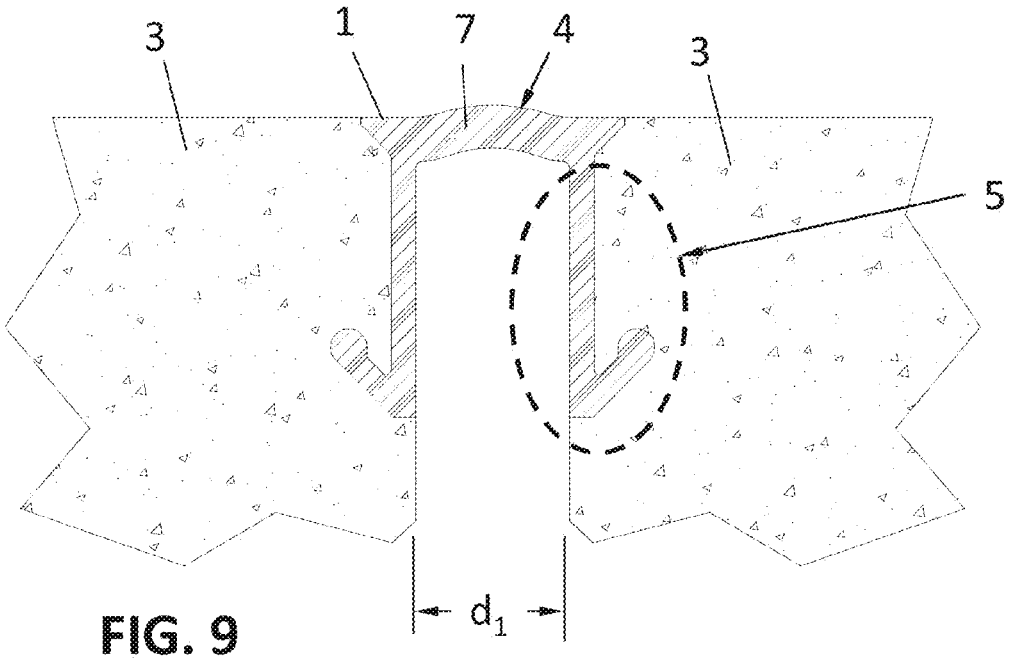
FIG. 9 shows a cross-sectional view of compliant trim 1, after the wooden form has rotted away, and some slab motion has occurred, resulting in a decreased gap $d_1$ with anchoring means 5 surrounded by concrete 3. Compliant trim 1 is in compression, resulting in a bulge of the surface 4.

The preferred embodiment of the invention is composed of two main elements. 1) the cover, which will be the only visible part of the invention after cure of the concrete, and 2) the anchoring means. Optionally, an edge treatment means may be added to the compliant trim, located at the intersection of the cover and the anchoring means. In reference to FIG. 5, the cover lies on the top of the form. The anchoring means protrude downward from the cover, along either side of the forms. The edge-producing means lies just below the surface, at the junction of the anchoring means and the surface. In a second embodiment, the edge treatment means is omitted on one or both sides, which will allow the invention to be used with traditional radius-trowel slab edge treatment. It consists of an anchoring means and a cover.

The edge treatment feature is located below the visible surface of the cover, and is essentially a mold to which the concrete will flow into and thereby acquire an edge shape. When employed, the edge treatment means presents the opposite geometry as is desired on the concrete edges.

Figure 10:
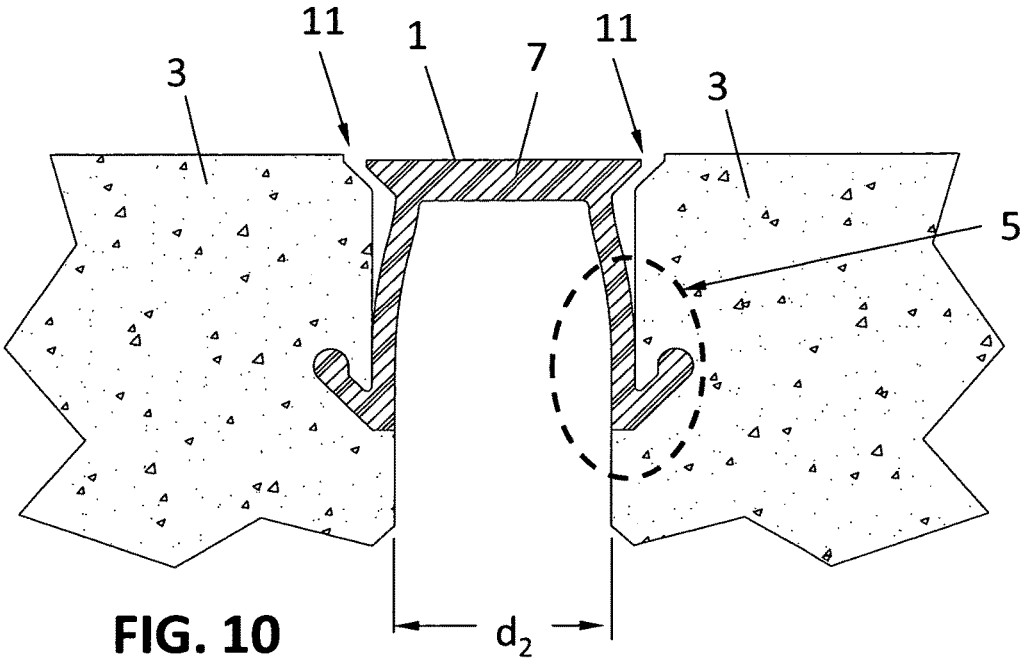
FIG. 10 shows a cross-sectional view of compliant trim 1, after the wooden form has rotted away, and some slab motion has occurred, resulting in an increased gap $d_2$, with anchoring means 5 surrounded by concrete 3. Compliant trim 1 is in tension, resulting in gaps 11, however, anchoring means 5 maintains contact and seal with concrete 3 due to the anchoring means 5.
Figure 11:
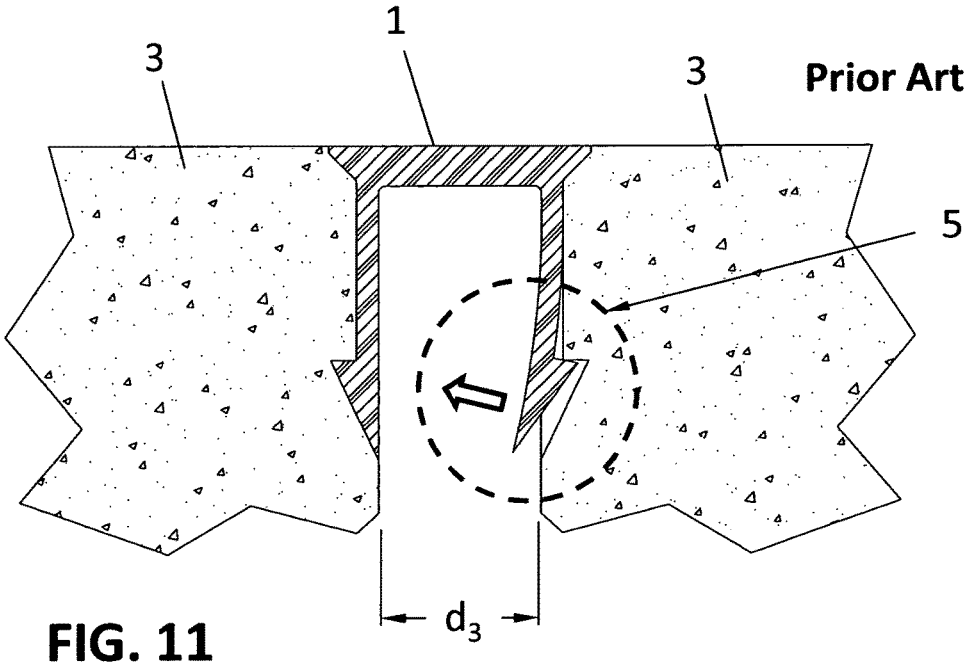
FIG. 11 shows a cross-sectional view of prior art compliant trim 1, between concrete slabs 3. Wooden forms have rotted away, leaving a cavity of width $d_3$. It is clear that this cross-section has minimal anchoring means 5, and will only marginally resist a vertical load in either direction. The anchoring means 5 provides no features to prevent collapse of the anchoring means 5 towards the center, indicated on the figure by an arrow, nor would it provide any resistance at all to an increase in the gap between the slabs (an increasing value of $d_3$).
Figure 12:
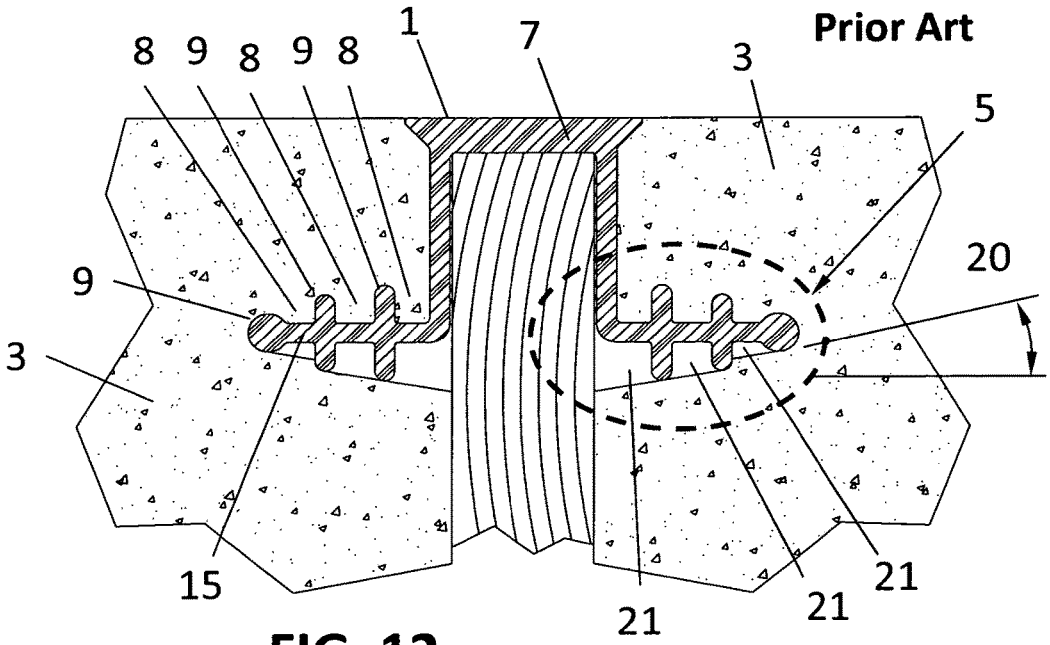
FIG. 12 shows a cross-section view of prior art. Anchoring means 5 consists of an extension 15, made up of a plurality of protrusions 9 and recesses 8. These protrusions and recesses, while preventing extraction of the compliant trim, will be almost impossible to completely fill, and will generally fill to the slump angle 20 of the concrete 3. This results in numerous voids 21, which effectively result in a large unsupported area of the slab 3. Additionally, this prior art profile is a continuous extrusion, which is subject to shrinkage along its length.
Figure 13:
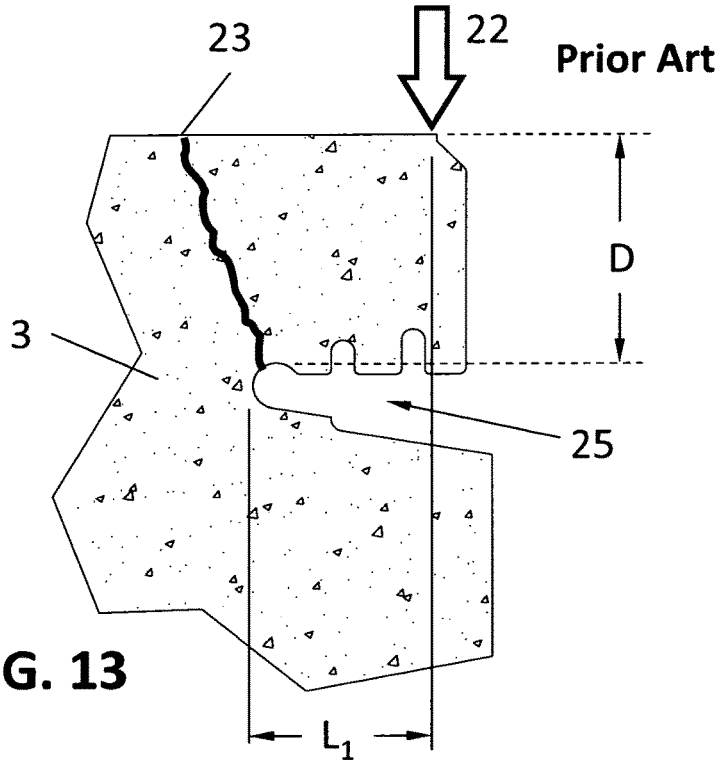
FIG. 13 shows a cross-section of a concrete slab 3, as would be created though the use of the compliant trim 1 shown in FIG. 12. Compliant trim 1 is not shown. Because the compressive strength of the compliant trim 1 is so much less than the concrete, ignoring it is a good approximation of how it will behave under load, acting as an inclusion 25. External loads are typically applied to such slabs by foot or wheeled traffic. External load 22 is applied in the worst case, to the edge of slab 3. Because the compliant trim 1 extended a distance L1 into the slab, at a depth D, creating inclusion 25, a cantilever beam of concrete is effectively created of length L1 and thickness D, and extending along the length of the slab 3. Applied load 22, will cause the concrete beam to experience tension at the surface, and if sufficiently large, will result in a crack 23 which will propagate to the inclusion 25.
Figure 14:
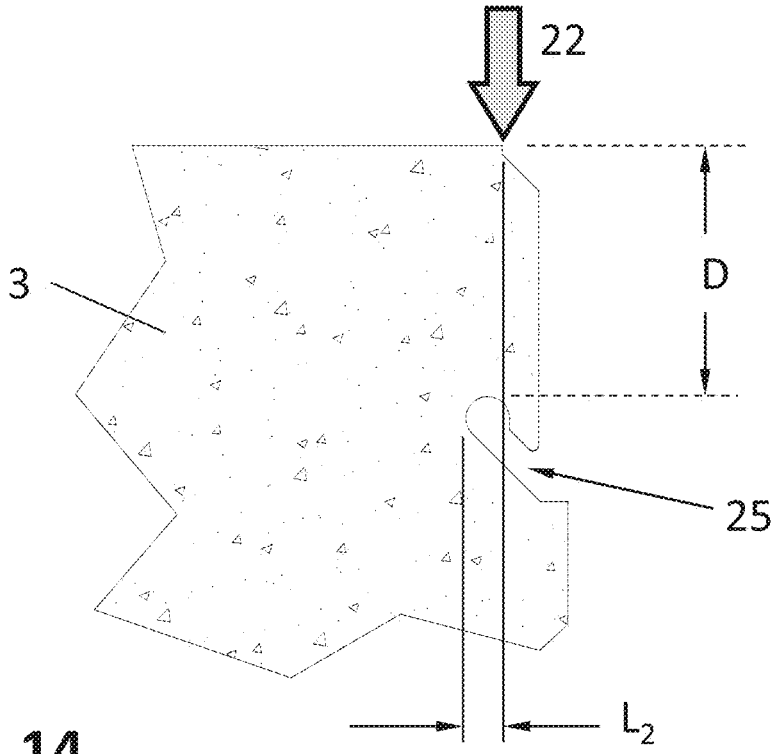
FIG. 14 shows a cross-section of a concrete slab 3, as would be created though the use of the compliant trim shown in FIG. 8. Note that the inclusion 25 created by the compliant trim 1 (not shown) extends a distance L2 into the slab 3, and has a depth D. As a result, the beam created in the concrete has length L2 and thickness D. Because distance L2 is <<L1, and Depth D is the same for both FIG. 13 and FIG. 14, the concrete slab of FIG. 14 will withstand a much higher load 22 than the slab shown in FIG. 13. It is apparent that edge damage will be greatly reduced through use of the present invention over prior art.
Figure 15:
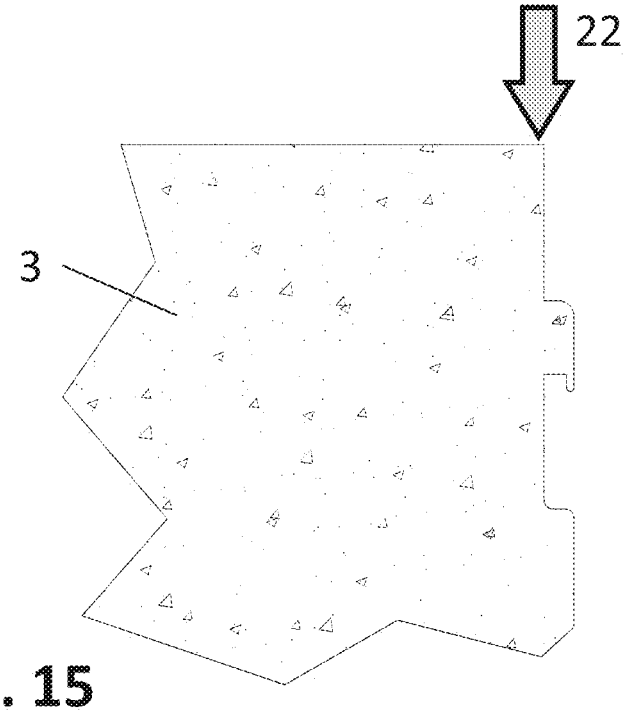
FIG. 15 shows the cross-section of a concrete slab 3, as would be produced through the use of a compliant trim 1 as illustrated by FIG. 16 and FIG. 17. Note that there is no inclusion at all. This slab will be the most resistant to breakage compared to those shown in FIG. 13 and FIG. 14.
Figure 16:
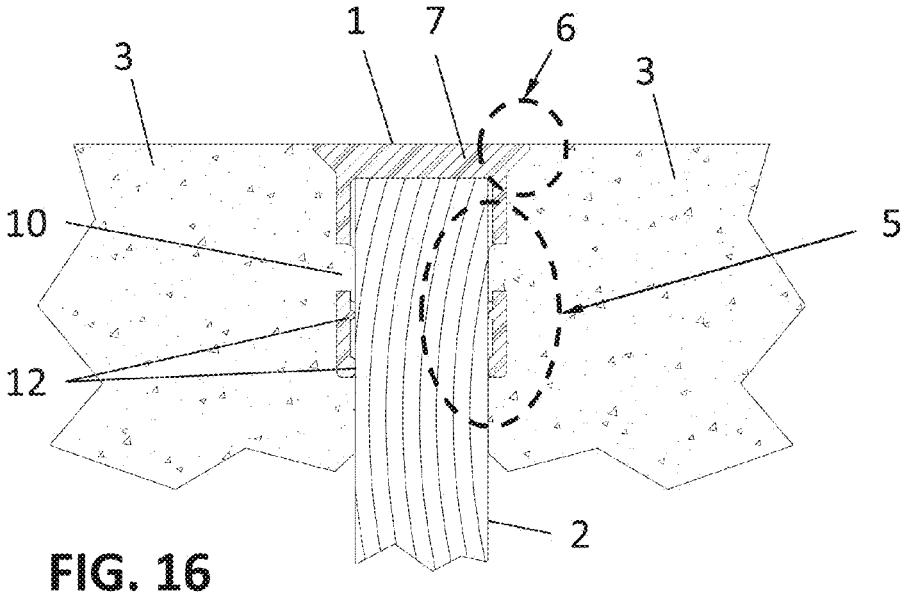
FIG. 16 shows a cross-sectional view of one embodiment of compliant trim 1, with a cover 7, an edge treatment 6, and an anchoring means 5 extending down from both sides of cover 7. Anchoring means 5 includes internal ribs 12, and holes 10, preferably placed at regular intervals along the length. The concrete slabs 3 are anchored to compliant trim 1 as some amount of concrete flows through holes 10, to occupy some of the space between anchoring means 5 and the form 2, created by the ribs 12.
Figure 17:
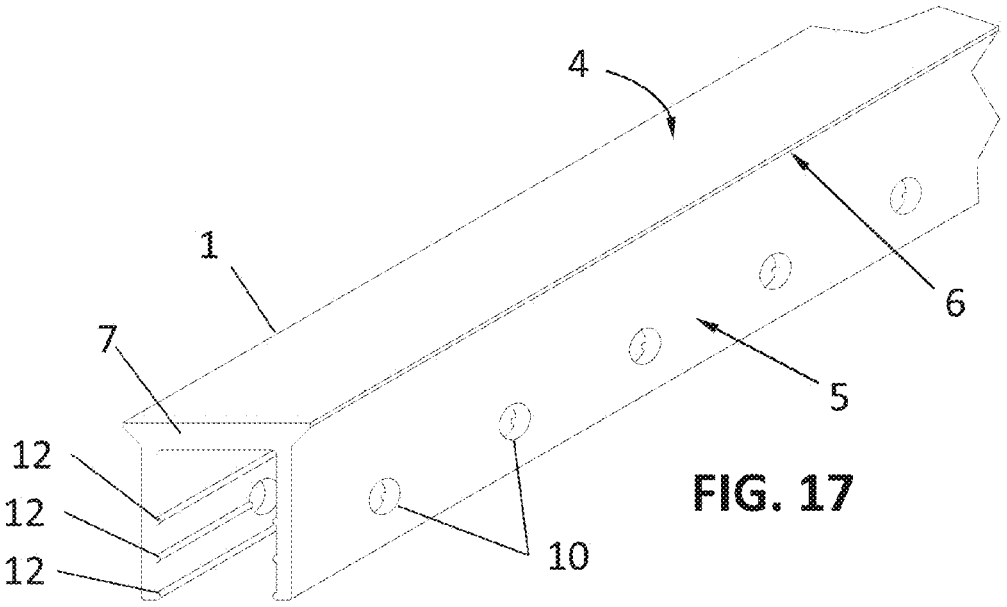
FIG. 17 shows an isometric view of one embodiment of the invention, as also shown in cross-section in FIG. 16. Compliant trim 1 has a surface 4, a continuous edge treatment 6, and an anchoring means 5 extending down from both sides of cover 7. Anchoring means 5 includes internal ribs 12, and holes 10, preferably placed at regular intervals along the length. The holes 10 present interruptions in the otherwise continuous profile.
Figure 18:
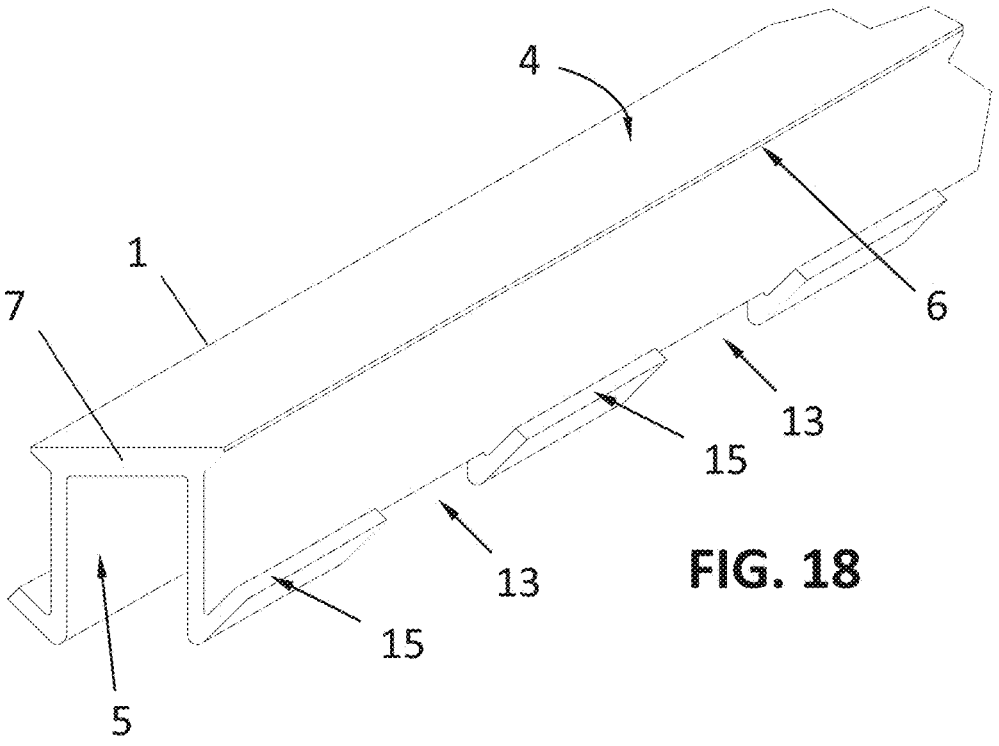
Figure 19:
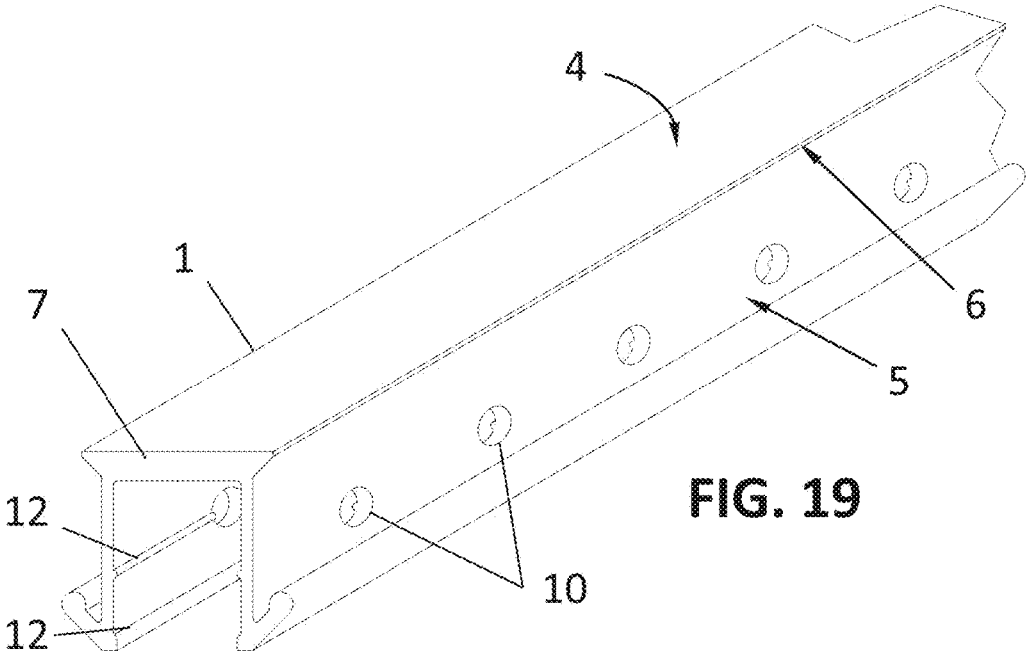
FIG. 19 shows an isometric view of the preferred embodiment of the invention, as also shown in cross-section in FIG. 5. Compliant trim 1 has a surface 4, a continuous edge treatment 6, and an anchoring means 5 extending down from both sides of cover 7. Anchoring means 5 includes internal ribs 12, and holes 10, preferably placed at regular intervals along the length. The holes 10 present interruptions in the otherwise continuous profile.
Figure 20:
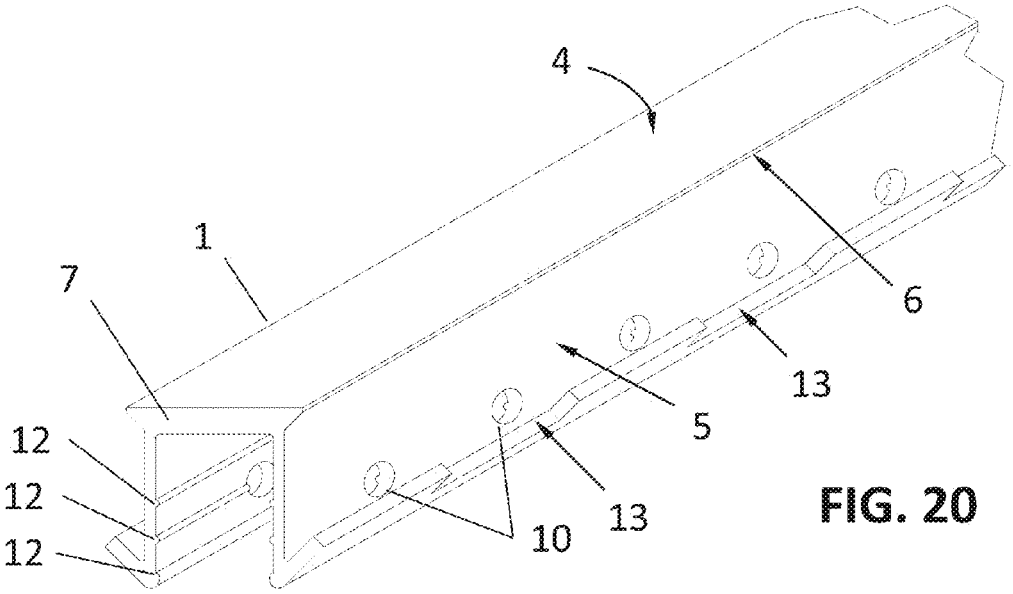
FIG. 20 shows an isometric view of an alternative embodiment of the invention, whereby anchoring means 5 consists of internal ribs 12, holes 10, and notches 13. This figure illustrates that additional features may be used to provide redundancy in the anchoring means 5, as both the holes 10 and notches 13 interrupt the otherwise continuous profile.
Figure 21:
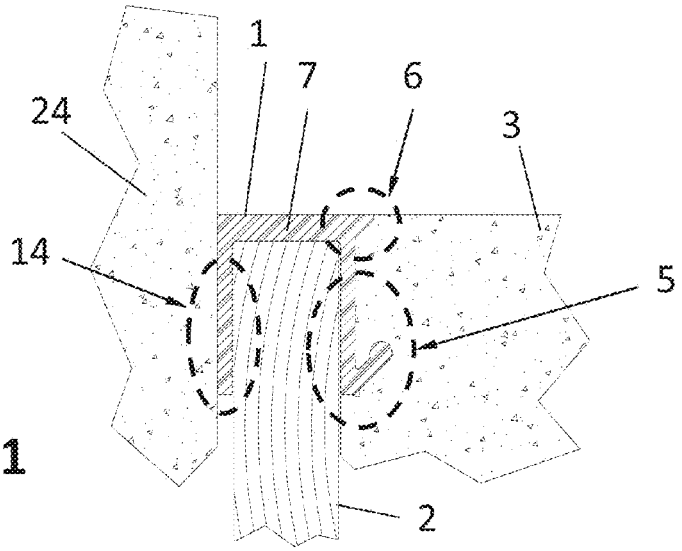
FIG. 21 is a cross-sectional view of a variant of the invention, intended for placement against walls 24. Cover 4 has a pair of downward projecting members on either side of wooden form 2. One of which is terminated in an anchoring means 5, the other is a form retention means 14. Anchoring means 5 is embedded in concrete 3. The form retention means 14 is used to hold the compliant trim 1 onto form 2, until the concrete 3 has been poured.
Figure 22:
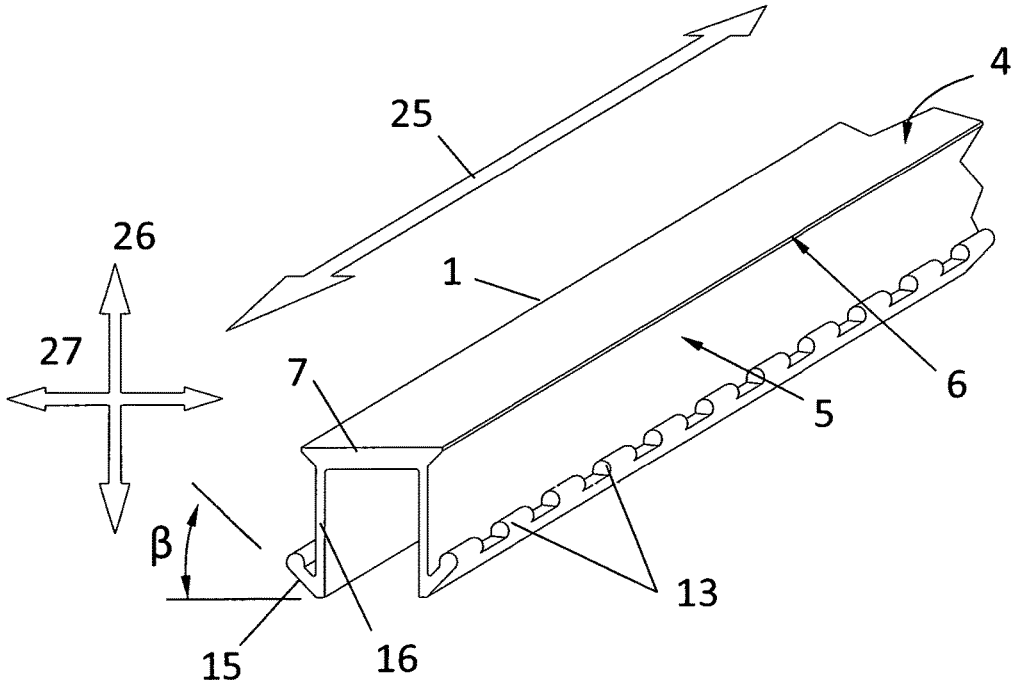
FIG. 22 is an isometric view of the invention. Compliant trim 1 has a surface 4, a continuous edge treatment 6, and an anchoring means 5 extending downward along the vertical axis 26 from both sides of cover 7. Anchoring means 5 consists of a downward projection 16, and an upward facing extension 15 at an angle β to the horizontal axis 27, with material removed or displaced 13 at multiple locations along the length 25 of the invention.
Figure 23:
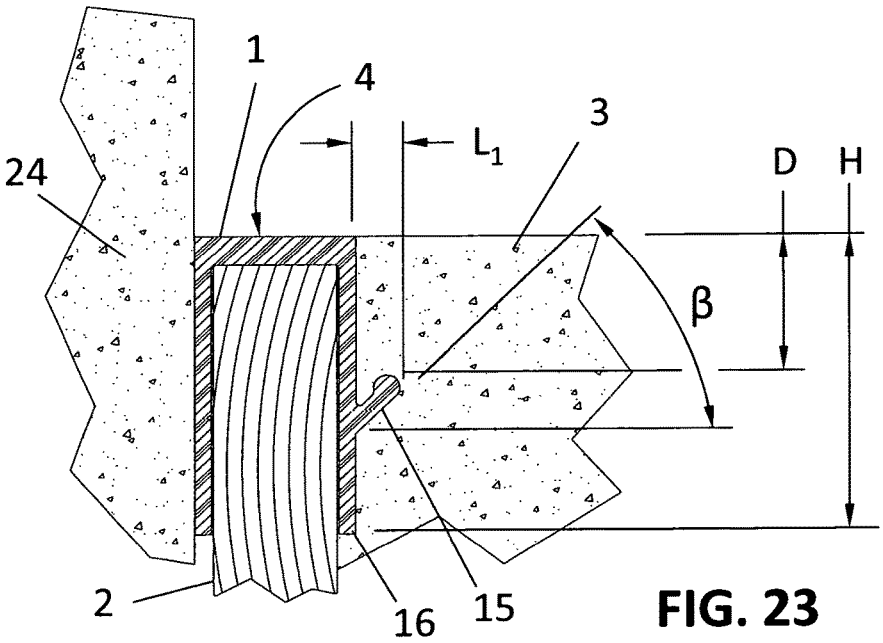
FIG. 23 is a cross-section view of the invention. Compliant trim 1 rests atop form 2, between slab 3 and wall 24. Slab 3 has a surface coincident with surface 4. Compliant trim 1 has a downward projection 16, and an upward facing extension 15. The minimum depth D from the upward facing extension 15 to the plane defined by surface 4 is greater than the maximum horizontal length $L_1$ of the upward facing extension 15 from the downward projection 16, by a factor of at least 2.5, and preferably 3 or more. It should be noted that the minimum depth D is with respect to the upward projection 15, and is not related to the length of downward projection 16, shown as depth H in the figure. Downward projection 16 may extend substantially beyond upward facing extension 15.

The cover is typically the thickest portion of the cross-section, as it is required to support the load of wheeled and pedestrian traffic even after the forms has rotted away. Use of the edge-treatment feature greatly enhances the ability of the surface to carry loads, as it will essentially act as a bridge between these two opposing slabs. Use of the edge producing feature also works to hide an expanding gap between the slabs, as this movement only becomes apparent when the gap becomes visible. FIG. 10 illustrates a gap that has increased in size due to the motion of the slabs away from each other. As can be seen in the figure, for displacements of the size shown, there is no direct line of sight into the vertical fissures below gaps 11, substantially concealing them.

The anchoring means may consist of one or several embodiments. The common characteristic is an interruption of an otherwise continuous extrusion profile. The non-continuous profile prevents the compliant trim from shrinking in length, and is essential to the invention. The non-continuous feature of the preferred embodiment consists of a series of holes in the side walls, onto which concrete is allowed to flow during the pour. The space behind these holes is small, however sufficient to allow some concrete to flow through and occupy the space. The concrete therefore holds the invention at each hole, providing numerous connections. The anchoring means of the preferred embodiment also has a single, upward facing arm, terminated is a round end, slightly larger in diameter than the arm. This feature provides pull-out resistance perpendicular to the slab, and produces a torturous path for water intrusion.

Many other methods may be used to provide an interrupted, or non-continuous extruded profile. Material may be physically removed from the extrusion, in any convenient shape, in a secondary notching, punching, or cutting operation. Material may also be compressed, thermally distorted, embossed, or the like to vary the profile along the length. It will be obvious to those versed in the art of plastic fabrication that many methods may be employed to vary the shape of a plastic form, and that any of these methods which vary the profile to enhance the anchoring means lie within the spirit of the invention.

What I claim is:

1. A compliant trim for concrete, applied to a top surface of forms prior to the pouring of concrete, comprised of:

a) a cover, situated on said top surface of said forms, and b) an anchoring means, attached to said cover, located on one or both sides of said forms, said anchoring means surrounded by said concrete, said anchoring means providing a mechanical lock against motion along the direction of the length of said compliant trim said mechanical lock produced by employing a non-continuous cross-section along said length of said anchoring means, said non-continuous cross-section produced by material removed or displaced from an otherwise continuous profile, said anchoring means comprised of an arm extending away and generally upward from said form, terminated in a substantially round feature of a diameter greater than the thickness of said arm, said round feature thereby minimizing stress concentration in said concrete.

2. The anchoring means of claim 1, whereby said arm extends horizontally into said concrete no more than one third the distance of the minimum depth of said arm from the surface of said concrete, thereby minimizing cantilever loads in said concrete.

3. The compliant trim of claim 1, whereby substantially none of the surfaces of said anchoring means surrounded by said concrete face the vertical, downward direction, nor do said surfaces face towards said form, thereby preventing entrapment of air in said concrete.

4. The compliant trim of claim 1, whereby an edge treatment means is additionally incorporated at the intersection of said cover and said anchoring means, said edge treatment means producing a chamfer, radius, or similar edge on said concrete.

5. A method of anchoring a form cover to concrete comprising:

producing said form cover of an elongated shape, with three orthogonal surfaces, to lie along three sides of an elongated, rectangular cross-sectioned concrete form, said form cover composed of a horizontal cap and a pair of downwardly extending members, one or both of said downwardly extending members incorporating an anchoring means with a substantially varying cross-section oriented perpendicular to the length of said form cover, said anchoring means extending from said downwardly extending members in an upward direction, said anchoring means possessing one or more enlarged areas of a generally rounded shape;

placing said form cover over three sides of said elongated, rectangular cross-section concrete form;

surrounding said varying cross-section portions of said anchoring means with said concrete;

and allowing said concrete to cure.

6. A form cover for concrete forms, applied to the top edge of said concrete forms prior to the pouring of concrete, said concrete forms of an elongated shape, employing a generally rectangular cross-section, generally oriented with a longer side of said rectangular cross-section in a vertical direction and said elongated shape oriented generally horizontally, comprised of:

a) a cover, situated on said top edge of said concrete forms, and b) an anchoring means, extending downwardly from said cover, located on one or both sides of said concrete forms, said anchoring means substantially covered by said concrete, said concrete providing mechanical interference against motion of said anchoring means along the direction of said elongated shape, said anchoring means employing some combination of material removed or displaced from an otherwise continuous extruded profile to achieve said mechanical interference, said anchoring means comprised of an arm extending away and generally upward from said concrete forms, said arm possessing one or more substantially round features of a size greater than the thickness of said arm.

7. The form cover of claim 6, whereby said anchoring means having at least one of said arms extending away from said concrete forms a distance no greater than 0.4 times the distance from the surface of said concrete to the proximate surface of said arm.

8. The anchoring means of claim 6, whereby none of the surface normals of said arm are oriented vertically downward or in the direction of said concrete forms.

* * * * *